US005175961A

United States Patent [19]

Bolton

[11] Patent Number: 5,175,961

[45] Date of Patent: Jan. 5, 1993

[54] DEVICE FOR SUPPORTING A MOVING PART

[75] Inventor: John R. Bolton, Knaresborough, United Kingdom

[73] Assignee: Penico Holdings LImited, Otley, United Kingdom

[21] Appl. No.: 792,149

[22] Filed: Nov. 11, 1991

[30] Foreign Application Priority Data

Nov. 14, 1990 [GB] United Kingdom ..... 9024709

[51] Int. Cl.[5] ..... B24B 13/00

[52] U.S. Cl. ..... 51/58; 51/216 LP; 51/65; 51/284 R; 51/160

[58] Field of Search ..... 51/216 LP, 217 L, 124 L, 51/58, 60, 160, 65, 284 R

[56] References Cited

U.S. PATENT DOCUMENTS 1,260,872 3/1918 Clement ..... 51/124 L
1,343,050 6/1920 Goodwin ..... 51/216 LP
3,828,483 8/1974 Blum ..... 51/124 L
3,886,696 6/1975 Brück ..... 51/216 LP

FOREIGN PATENT DOCUMENTS 0056863 4/1985 Japan ..... 51/216 LP
0141463 7/1985 Japan ..... 51/216 LP
0124256 5/1990 Japan ..... 51/216 LP

*Primary Examiner*—Robert A. Rose
*Attorney, Agent, or Firm*—Emrich & Dithmar

[57] ABSTRACT

A device for supporting an article 27 such as a lapping tool for polishing lenses is designed to allow limited motion of the article about a central point. The device comprises a base 1, a mount 2 and a bearing between the base and the mount allowing the said motion of the article when in place on the mount; while previously the joint has been a complicated gimbal arrangement, which is difficult to maintain, in the invention the bearing comprises a ball-and-socket-type joint 9,14.

9 Claims, 3 Drawing Sheets

DEVICE FOR SUPPORTING A MOVING PART

FIELD OF THE INVENTION

The invention relates to supports, particularly for workpieces or machining parts, allowing limited movement about a central point or axis, in particular in the form of a rubbing or wobbling motion. Such a support is used in lens smoothing or polishing where a shaft supporting a lapping tool is required to perform limited movements away from a rest position so as to smooth or polish a lens, resting on the tool, to the desired surface finish by means of a smoothing or polishing powder.

BACKGROUND OF THE INVENTION

In a prior proposal a gimbal mount was used to provide a supporting shaft with the appropriate freedom of movement. This was, seen to be unsatisfactory because the bearings would wear out very quickly and, even with repeated replacement of the bearings every few weeks, the apparatus had an average life span of about six months.

The wearing down of the bearings was attributed to two main causes, the first being that the motion of the apparatus required the bearings to rotate by angles rarely exceeding 15°, causing very uneven wear, and the second being that emery powder washed down from the grinding surface was able to get into the bearings, rapidly rendering them unusable.

Although the bearings can be shielded to a certain extent from the grinding powder by rubber sheets and washers such protection has never been completely effective and in any case makes replacement of the bearings more difficult.

SUMMARY OF THE INVENTION

It is therefore an object of the invention to design a support for an article, such as a lapping or polishing tool, which has to carry out a wobbling motion, in such a way that the support has a substantially longer lifetime than conventional devices. A further object is to provide such a support which is of considerably simpler construction than previously.

According to the present invention there is provided a device for supporting an article so as to allow limited motion of the article, comprising a base, a mount and a bearing between the base and the mount allowing the said motion of the article when in place on the mount, wherein the bearing comprises a ball-and-socket-type joint.

By "limited motion" is meant in particular motion with only two degrees of freedom, such as over the surface of a spheroid or cylinder, for instance. The apparatus of the invention is particularly suitable for supporting tools or workpieces for lens smoothing or polishing, where the allowable motion required is usually over a spherical surface subtending a small angle at the centre of the sphere (i.e. at the bearing), such as about 15°.

Since with support devices made in accordance with the invention the number of parts having surfaces moving relative to each other is reduced to two, the amount of maintenance necessary may be greatly reduced. Ball-and-socket-type joints are in any case less prone to malfunction caused by limited bearing movement such as occurs in lens grinding apparatus since considerably more wear can be tolerated before the bearing is no longer usable than in, say, a bearing incorporating a ball race.

Preferably the ball member is generally spherical and the cup or socket likewise spherical, though advantageously with a slightly greater radius than that of the ball to prevent jamming, at their respective bearing surfaces. This allows wobbling movement in all directions.

In an advantageous configuration the ball member is mounted on the upper end of a vertically extending stem of the base, and the socket is set facing downwards in the mount. In this case there is substantial built-in protection for the bearing from abrasive powder since the orientation of the socket member acts as a shield against contamination, rendering rubber washers and similar measures largely unnecessary.

The ball and socket members are preferably replaceably mounted in the base and workpiece mount so that when they finally do need replacing this involves the minimum of effort and expenditure. This may be realized by providing the ball mamber with a stem, as mentioned above, which can be attached to the base by a screw, for instance, and incorporating the socket into a rod-shaped insert which can slide into and be fastened to the workpiece mount.

For smoothing or polishing of an aspheric lens it is essential that the mount for the lapping or polishing tool does not rotate about its own axis. In advantageous embodiments of the invention, therefore, a restraint is provided which is so shaped and positioned as substantially to prevent the mount, and hence the workpiece, from rotating about its own axis, whilst at the same time allowing it sufficient freedom to rotate in the direction or directions allowed by the bearing, namely about any axis perpendicular to the bearing axis, which is generally vertical. The amount of rotation allowed should be about 15° to provide a rubbing or wobbling motion.

The restraining means should thus be relatively easily movable or deformable about horizontal axes, i.e. axes perpendicular to the axis of the mount in its resting position, while being relatively stiff with respect to twisting about the vertical axis. To this end the restraining means may consist of one or more flat springs with their plane perpendicular to the axis of the bearing, connected between the base and the mount. In a preferred embodiment there are two springs each extending to an attachment point in the mount from a bracket on the base, the brackets being arranged one on each side of the mount; preferably the springs have a hook shape so as to extend from their brackets round each side of the mount respectively to attachment points on the far side of the mount. This allows the use of a longer spring for a given bracket spacing and facilitates the bending and twisting necessary to follow the motion of the mount. The use of springs has the further advantage that the springs also have a restoring function, which makes the device easy to handle.

The base advantageously comprises two side brackets as mentioned above for attaching the restoring means, and a central arm generally parallel to the brackets, for supporting the ball or socket member; in the particularly simple arrangement where the ball has an integral stem, as discussed above, this stem can be inserted and secured into the arm, allowing easy replacement when necessary.

The mount is preferably in the form of a shaft on one end of which the workpiece or tool can be located, the shaft having an enlarged hollow central portion defining a recess for accommodating the end of the arm with the ball or socket piece. The socket or ball member, as the case may be, is located correspondingly in the recess. Advantageously the shaft is at least partly tubular so that a socket insert can be fitted in the shaft between one end and the central recess, as mentioned above, again so as to allow replacement of the socket in a simple fashion.

For a better understanding of the invention an embodiment will now be described by way of example with reference to the accompanying drawings.

DESCRIPTION OF THE PREFERRED EMBODIMENT

Figure 1:
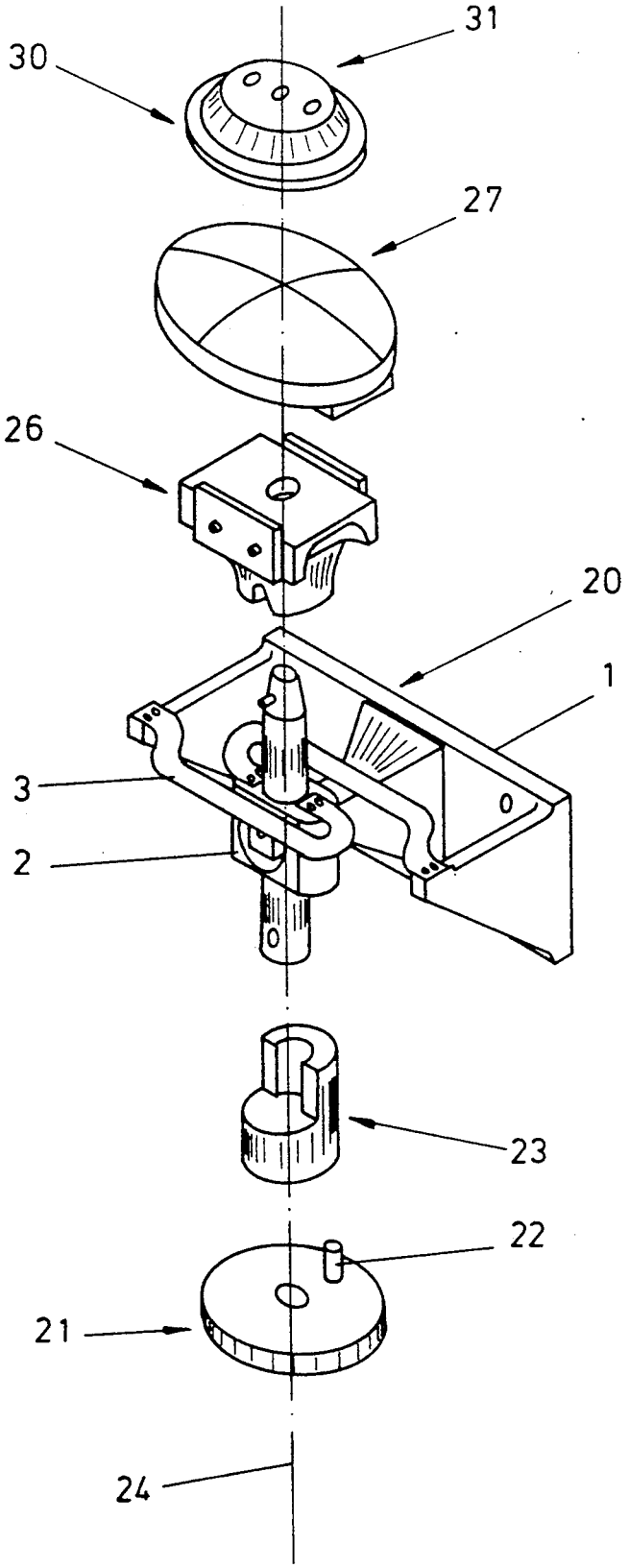
FIG. 1 shows an exploded view of a lens-smoothing or polishing apparatus in accordance with the invention.

FIG. 1 is an exploded view of a support unit for a lens smoothing or polishing machine. The main component of the support unit, namely the support or "wobble unit" 20, comprises two relatively movable parts 1 and 2 and is described in detail below. The fixed part or base 1 is bolted to the machine frame and the movable mount in the form of a shaft 2 is driven by a motor (not shown). The motor rotates a driving plate 21 with an offset pin 22 engaging in a self-aligning bearing fitted to the underside of the shaft adapter 23 so as to rotate the lower end of the shaft 2 around the central vertical axis. In FIG. 1 the shaft is shown in its rest position, aligned with the central axis; in use, however, the pin 22 would engage the adapter 23 so as to hold it inclined to the central axis.

Figure 2:
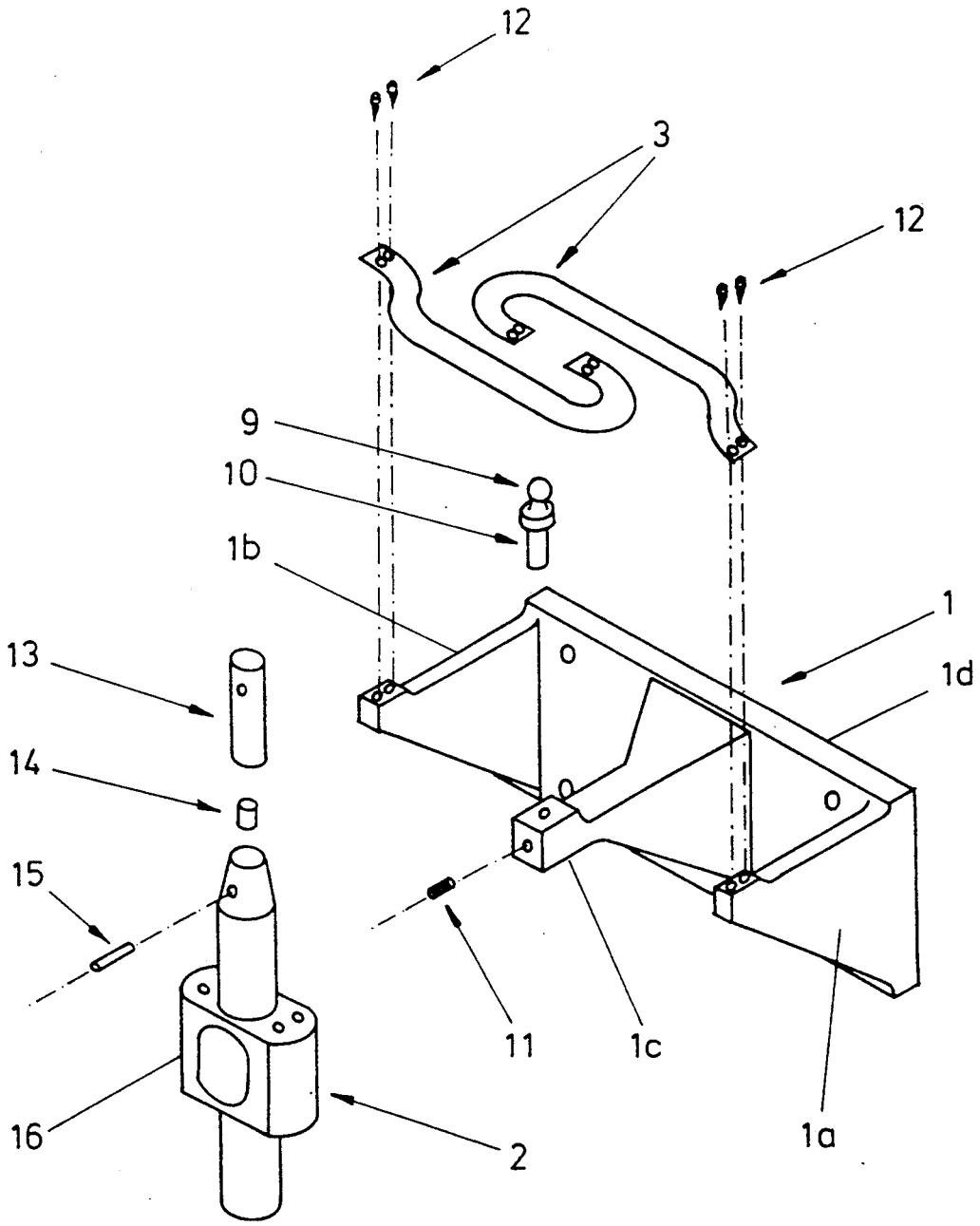
FIG. 2 shows an exploded view of the lapping tool support of the above apparatus.

The shaft 2 is mounted on the base 1, in a way described more fully in connection with FIG. 2, so as to allow the axis of the shaft to tilt about any horizontal axis. Thus, rotation of the lower end of the shaft about the central, vertical axis causes the upper end to rotate ("wobble") correspondingly. The lapping tool 27 moounted on the upper end of the shaft 2 via clamp 26 therefore performs a generally rotary movement, the inclination of the axis of the shaft to the central about axis which it precesses or wobbles being about 15°.

The support device 20 in accordance with the invention is shown in an exploded view in FIG. 2. It can be seen that the base 1 consists of two brackets 1*a*, 1*b* and an arm 1*c* attached to a backplate 1*d*. The base 1 supports the shaft 2, which is mounted on the arm 1*c* of the base via a single bearing located within an enlarged central portion 16 of the shaft 2 as described below.

The support device 20 includes two flat, hook-shaped springs 3 lying in the horizontal plane, use to attach the shaft resiliently to the brackets 1*a* and 1*b* of the base. The springs are fastened to the brackets by means of screws 12 and similarly to the enlarged central portion 16 of the shaft 2.

The springs are designed as a restraining means so as substantially to prevent the shaft from rotating about its own axis while permitting a tilting or rotating motion about axes perpendicular to this axis, i.e. horizontal axes. To this end it is advantageous to make the length of the springs relatively large; hence the hook shape clearly shown in FIG. 2. This reduces stress in the springs and helps to increase the lifetime of the article.

Figure 3:
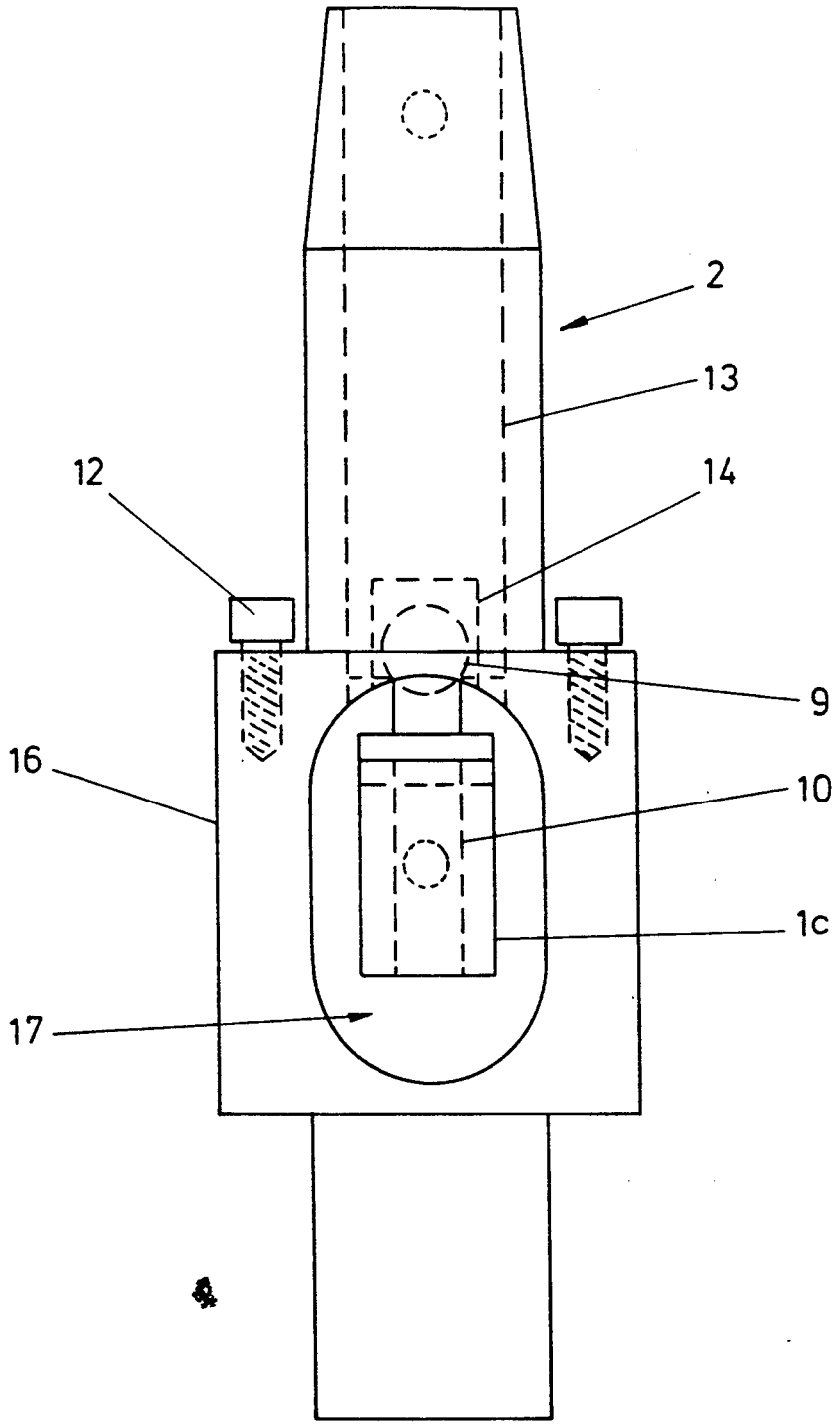
FIG. 3 shows the support shaft in elevation.

The bearing between the shaft 2 and the base 1 is of particularly simple construction and a consists essentially of a ball member 9 fixed to the base and a socket member 14 fixed to the shaft. The ball 9 is fastened to a stem 10, which in turn is secured to the end of the arm 1*c* by means of a locking screw 11. The arrangement allows easy replacement of the ball when worn. Likewise the socket member 14, in the form of a cup having a generally spherical recess, fits into an insert 13 itself secured by an axis alignment pin 15 into a cylindrical recess in the upper part of the shaft 2, as best seen in FIG. 3. The thickened central portion 16 has a central recess 17 large enough to allow the end of the arm 1*c* with the ball to be inserted into the recess 17 of the shaft so that the shaft can be lowered on to the arm until the ball locates into the socket member 14 inside the shaft 2 so enabling the shaft to be freely rotatably mounted on the arm about the centre of the ball. The recess 17 must be of suitable size and shape to allow the desired limited movement of the shaft.

In use, a pre-ground lens 30 (FIG. 1) is held rigidly to a holder 31 by way of a suitable adhesive. The lens is held firmly against the lapping tool (27) by introducing the desired downward pressure to the lens holder 31, and smoothing or polishing powder in suspension can then be supplied to the interface between the lens and the lapping tool, so that the smoothing or polishing of the lens can be performed.

The downward pressure on the lens holder 31 is applied by a biasing arrangement, not shown, with two downwardly projecting pins engaging in the two off-axis indentations shown in the holder. The holder can thus tilt about the horizontal axis defined by the indentations, and in addition the pin arrangement can itself tilt about the other horizontal axis. In this way the lens can be pressed conformally against the lapping tool 27 as the latter moves, while at the same time being prevented from rotating about the vertical by virtue of the two-pin arrangement. This is essential for aspherical lenses, i.e. lenses where the radii of curvature are different in the two orthogonal directions, as indicated in FIG. 1.

During operation the bottom of the shaft 2 is rotated in a horizontal plane via the pin 22 at a relatively high speed. Simultaneously the axis of rotation of the driving plate 21 is itself rotated at a consistently lower speed so that the shaft in fact follows a convoluted path. This ensures a uniform rubbing effect over the surface of the lens.

The bearing of the shaft on the base comprises only one pair of sliding or rolling surfaces, namely the surfaces of the ball member and socket member. This itself reduces the amount of maintenance necessary. In addition, as can be seen from FIG. 3 in particular, the bearing is itself concealed within a void, namely the recess 17, so that it is further shielded from the abrasive powders necessarily given off in the lens smoothing or polishing process, which are particularly harmful to moving parts in this type of apparatus.

Furthermore, a ball-and-socket joint is less prone to failure as a result of wearing than is a gimbal mount as constant motion tends to wear the ball and socket evenly in any case. With carbide steel bearing members the bearing can be expected to last many months, if not years—far longer than the traditional bearings—and it is a simple operation to replace the ball and socket parts.

While the present invention has been described in terms of its use for lens smoothing and polishing, especially in ophthalmological applications, it is by no means restricted to these uses and applications may be found in many areas where restricted motion about a plurality of axes, in particular motion over a part-spherical surface, is required.

I claim:

1. A device for supporting an article so as to allow limited motion of the article, said device comprising: a base, a mount, a bearing between the base and the mount allowing the said motion to be imparted to the article when in place on the mount by appropriate movement of the mount, said bearing being a ball-and-socket-type joint including a ball member and a socket member, and restraining means provided between the mount and the base to allow said limited motion while at the same time preventing the mount from rotating about its own axis, the restraining means including spring means being relatively stiff with respect to twisting about the axis of the mount but relatively yielding about axes perpendicular to the axis of the mount.

2. A device according to claim 1, in which the base includes a stem, the ball member is mounted on the upper end of this stem and the socket member is set in the mount so as to face the ball member.

3. A device according to claim 2, and further comprising means for replaceably mounting the ball and socket members in the base and the mount.

4. A device according to claim 3, and further comprising a rod-shaped insert slidably fastened in the mount, said socket member being disposed on said insert.

5. A device according to claim 1, in which a restraining means is provided between the mount and the base in such a manner as to allow the said limited motion while at the same time preventing the mount from rotating about its own axis.

6. A device according to claim 1, in which said spring means includes one or more flat springs disposed in a plane which is generally perpendicular to the axis of the bearing.

7. A device according to claim 1, in which the base includes a projecting arm the projecting end of which supports the ball member, and the mount is formed as a shaft including a central portion which has a recess accommodating said end of the arm and the ball member, the socket member being located in the recess and engaging in use with the ball member.

8. A device according to claim 7, in which the base includes two side brackets respectively disposed at either side of and generally parallel to the projecting arm, the springs each being fixed at one end respectively to the brackets.

9. An apparatus for smoothing or polishing lenses, comprising: a base, a mount and a bearing between the base and the mount allowing a predetermined limited motion between the base and the mount; restraining means between the mount and the base to allow said limited motion while at the same time preventing the mount from rotating about its own axis, the restraining means including spring means being relatively stiff with respect to twisting about the axis of the mount but relatively yielding about axes perpendicular to the axis of the mount; a tool attached to the mount for carrying out said smoothing or polishing; a lens holder for holding a lens in contact with the tool; and drive means for rotating the mount so as, in use, to rub the tool against a lens; wherein said bearing is a ball-and-socket-type joint.

* * * * *